US011732329B2

(12) United States Patent
Matsunaga et al.

(10) Patent No.: US 11,732,329 B2
(45) Date of Patent: Aug. 22, 2023

(54) COPPER ALLOY, COPPER ALLOY PLASTIC-PROCESSED MATERIAL, COMPONENT FOR ELECTRONIC AND ELECTRIC DEVICES, TERMINAL, BUS BAR, AND HEAT-DIFFUSING SUBSTRATE

(71) Applicant: MITSUBISHI MATERIALS CORPORATION, Tokyo (JP)

(72) Inventors: Hirotaka Matsunaga, Aizuwakamatsu (JP); Yuki Ito, Ageo (JP); Hiroyuki Mori, Tsukuba (JP); Hiroyuki Matsukawa, Iwaki (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 17/779,850

(22) PCT Filed: Nov. 27, 2020

(86) PCT No.: PCT/JP2020/044229
§ 371 (c)(1),
(2) Date: May 25, 2022

(87) PCT Pub. No.: WO2021/107096
PCT Pub. Date: Jun. 3, 2021

(65) Prior Publication Data

US 2023/0002860 A1 Jan. 5, 2023

(30) Foreign Application Priority Data

Nov. 29, 2019 (JP) ..... 2019-216549

(51) Int. Cl.

| | |
|---|---|
| ***C22C 9/00*** | (2006.01) |
| ***C22C 1/04*** | (2023.01) |
| *H01B 1/02* | (2006.01) |

(52) U.S. Cl.
CPC ..... *C22C 9/00* (2013.01); *C22C 1/0425* (2013.01); *C22C 2200/00* (2013.01); *H01B 1/026* (2013.01)

(58) Field of Classification Search
None
See application file for complete search history.

(56) References Cited

U.S. PATENT DOCUMENTS

2021/0002743 A1 1/2021 Matsunaga et al.

FOREIGN PATENT DOCUMENTS

| | | | |
|---|---|---|---|
| JP | 2016056414 | A | 4/2016 |
| JP | 2017179493 | A | 10/2017 |
| JP | 2019178398 | A | 10/2019 |
| JP | 2019178399 | A | 10/2019 |
| WO | 2019189534 | A1 | 10/2019 |
| WO | 2019189558 | A1 | 10/2019 |

OTHER PUBLICATIONS

International Search Report dated Feb. 16, 2021 for the corresponding PCT International Patent Application No. PCT/JP2020/044229, 5 pages including English translation.

*Primary Examiner* — Alexandra M Moore
(74) *Attorney, Agent, or Firm* — Leason Ellis LLP; Melvin C. Garner; Mitsuhiro Haraguchi

(57) ABSTRACT

A copper alloy has a composition including: 70 mass ppm or more and 400 mass ppm or less of Mg; 5 mass ppm or more and 20 mass ppm or less of Ag; less than 3.0 mass ppm of P; and a Cu balance containing inevitable impurities. In the copper alloy, the electrical conductivity is 90% IACS or more, and the average value of KAM values is 3.0 or less.

11 Claims, 1 Drawing Sheet

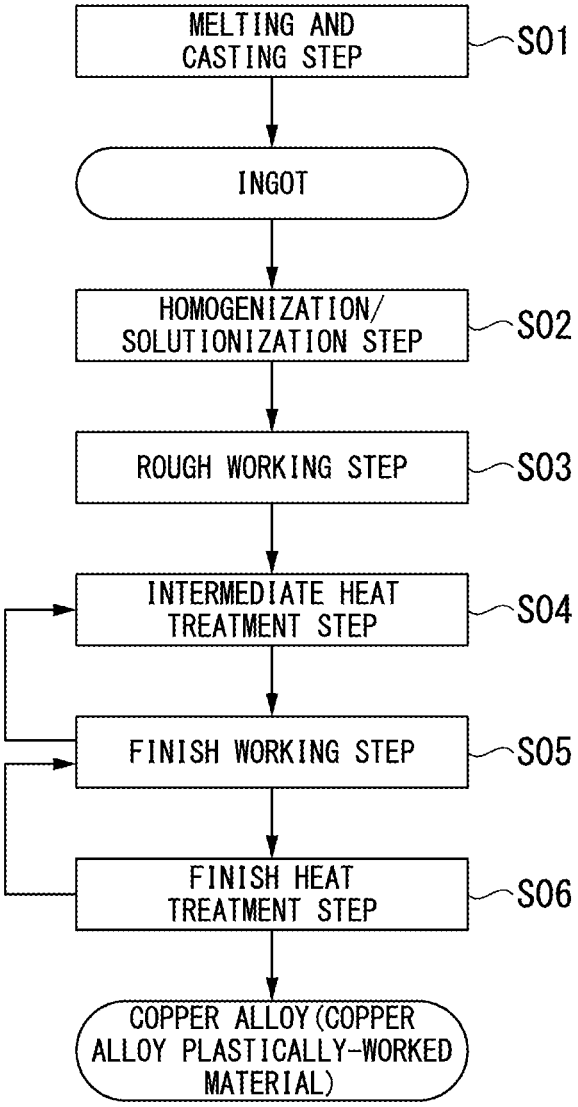
MELTING AND CASTING STEP
S01
INGOT
HOMOGENIZATION/ SOLUTIONIZATION STEP
S02
ROUGH WORKING STEP
S03
INTERMEDIATE HEAT TREATMENT STEP
S04
FINISH WORKING STEP
S05
FINISH HEAT TREATMENT STEP
S06
COPPER ALLOY (COPPER ALLOY PLASTICALLY-WORKED MATERIAL)

COPPER ALLOY, COPPER ALLOY PLASTIC-PROCESSED MATERIAL, COMPONENT FOR ELECTRONIC AND ELECTRIC DEVICES, TERMINAL, BUS BAR, AND HEAT-DIFFUSING SUBSTRATE

CROSS-REFERENCE TO RELATED PATENT APPLICATIONS

This application is a U.S. National Phase Application under 35 U.S.C. § 371 of International Patent Application No. PCT/JP2020/044229 filed on Nov. 27, 2020 and claims the benefit of priority to Japanese Patent Applications No. 2019-216549 filed on Nov. 29, 2019, the contents of all of which are incorporated herein by reference in their entireties. The International Application was published in Japanese on Jun. 3, 2021 as International Publication No. WO/2021/107096 under PCT Article 21(2).

FIELD OF THE INVENTION

The present invention relates to a copper alloy suitable for components for an electric or electronic device such as busbars, terminals, and heat dissipation substrates, a copper alloy plastically-worked material made of this copper alloy, a component for an electric or electronic device, a terminal, a busbar, and a heat dissipation substrate.

BACKGROUND OF THE INVENTION

Conventionally, highly electrical conductive copper or copper alloys have been in use for components for an electric or electronic device such as busbars, terminals, and heat dissipation substrates.

In response to an increase in the current in electronic devices, electric devices, or the like, attempts have been made to increase the sizes and thicknesses of components for an electric or electronic device that are used in these electronic devices, electric devices, and the like in order for a decrease in the current density and the diffusion of heat attributed to Joule heat generation.

Pure copper materials such as oxygen-free copper having excellent electrical conductivity are applied to cope with large currents. However, there has been a problem in that the pure copper materials had poor stress relaxation resistance and cannot be used in high-temperature environments.

Therefore, Japanese Unexamined Patent Application, First Publication No. 2016-056414 discloses a rolled copper sheet containing Mg in a range of 0.005 mass % or more and less than 0.1 mass %.

Since the rolled copper sheet described in Japanese Unexamined Patent Application, First Publication No. 2016-056414 has a composition in which Mg is contained in a range of 0.005 mass % or more and less than 0.1 mass % and the balance is composed of Cu and inevitable impurities, it has been possible to form solid solutions of Mg in the matrix of copper, and it has been possible to improve the strength and the stress relaxation resistance without significantly reducing the electrical conductivity.

CITATION LIST

Patent Document

[Patent Document 1]
Japanese Unexamined Patent Application, First Publication No. 2016-056414

Technical Problem

Incidentally, in recent years, pure copper materials have been often used in high-temperature environments such as an engine room, and there has been a need to improve the stress relaxation resistance, which was also true conventionally. Furthermore, in order to further suppress the generation of heat when a large current is caused to flow, there has been a need to further improve the electrical conductivity. That is, there has been a demand for a copper material having an electrical conductivity and stress relaxation resistance that are improved in a well-balanced manner.

In a case where the thickness has been increased, the bending conditions for forming components for an electric or electronic device become strict, and thus there is another demand for excellent bendability.

This invention has been made in view of the above-described circumstances, and an objective of the present invention is to provide a copper alloy, a copper alloy plastically-worked material, a component for an electronic and electronic device, a terminal, and a busbar having high electrical conductivity and excellent stress relaxation resistance and being excellent in terms of bendability.

SUMMARY OF THE INVENTION

Solution to Problem

As a result of intensive studies by the present inventors in order to solve this problem, it has been clarified that, in order to improve the electrical conductivity and the stress relaxation resistance in a well-balanced manner, a control of the composition alone is not sufficient, and it is necessary to perform a texture control according to the composition. That is, it was found that, when an optimum composition and a texture control are both achieved, it becomes possible to improve the electrical conductivity and the stress relaxation resistance in a well-balanced manner on a higher level than before. In addition, it was found that, when an optimum composition and a texture control are both achieved, it becomes possible to improve the bendability.

The present invention has been made based on the above-described findings, and a copper alloy that is one aspect of the present invention has a composition including: 70 mass ppm or more and 400 mass ppm or less of Mg; 5 mass ppm or more and 20 mass ppm or less of Ag; and a Cu balance containing inevitable impurities; in which a P content is set to less than 3.0 mass ppm, in which an electrical conductivity is set to 90% IACS or more, and an average value of KAM (Kernel average misorientation) values is 3.0 or less, the KAM values being obtained by: analyzing orientation differences of each of crystal grains by using an EBSD method in a measurement area of 10000 $\mu m^2$ or more in a step of a measurement interval of 0.25 μm, excluding measurement points having a CI value of 0.1 or less; calculating an average crystal grain size A by using area fraction, regions between neighboring measurement points where the orientation differences therebetween is 15° or more being defined as crystal grain boundaries; measuring the orientation differences in a step of a measurement interval that is 1/10 or less of the average crystal grain size A; analyzing the orientation differences of each of the crystal grains in a plurality of view fields including 1000 or more of the crystal grains in total, each of the view fields having 10000 $um^2$ or more of a measurement area, excluding measurement points where a CI value analyzed with data analysis software OIM is 0.1 or less; obtaining the KAM values as values when grain boundaries are defined as boundaries having 5° or more of orientation differences between neighboring pixels.

According to the copper alloy having this configuration, since the Mg, Ag, and P contents are specified as described above, and the average value of the KAM values is specified to 3.0 or less, it is possible to improve the stress relaxation resistance without significantly decreasing the electrical conductivity, and it becomes possible to achieve both high electrical conductivity of 90% IACS or more and excellent stress relaxation resistance. In addition, it also becomes possible to improve the bendability.

In the copper alloy that is one aspect of the present invention, it is preferable that a 0.2% yield strength is set in a range of 150 MPa or more and 450 MPa or less.

In this case, since the 0.2% yield strength is set in the range of 150 MPa or more and 450 MPa or less, even when the copper alloy is wound into a coil shape as a sheet strip material having a thickness of more than 0.5 mm, no curls are formed, handling is easy, and high productivity can be achieved. Therefore, the copper alloy is particularly suitable as a copper alloy for components for an electric or electronic device such as terminals, busbars, and heat dissipation substrate for large currents and high voltages.

In the copper alloy that is one aspect of the present invention, the average crystal grain size is preferably set in a range of 10 μm or more and 100 μm or less.

In this case, since the average crystal grain size is set in the range of 10 μm or more and 100 μm or less, crystal grain boundaries that serve as the diffusion paths of atoms are not present more than necessary, and it becomes possible to reliably improve the stress relaxation resistance.

In the copper alloy that is one aspect of the present invention, the residual stress rate is preferably set to 50% or more at 150° C. after 1000 hours.

In this case, the residual stress rate is set to 50% or more at 150° C. after 1000 hours, the stress relaxation resistance is excellent, and the copper alloy is particularly suitable as a copper alloy configuring components for an electric or electronic device that are used in high-temperature environments.

A copper alloy plastically-worked material that is one aspect of the present invention is made of the above-described copper alloy.

According to the copper alloy plastically-worked material having this configuration, the copper alloy plastically-worked material is made of the above-described copper alloy and is thus excellent in terms of an electrical conductive property, stress relaxation resistance, and bendability and is particularly suitable as a material of components for an electric or electronic device such as thickened terminals, busbars, and heat dissipation substrates.

The copper alloy plastically-worked material that is one aspect of the present invention may be a rolled sheet having a thickness in a range of 0.5 mm or more and 8.0 mm or less.

In this case, since the copper alloy plastically-worked material is a rolled sheet having a thickness in a range of 0.5 mm or more and 8.0 mm or less, components for an electric or electronic device such as terminals, busbars, and heat dissipation substrate can be formed by performing punching or bending on this copper alloy plastically-worked material (rolled sheet).

The copper alloy plastically-worked material that is one aspect of the present invention preferably has a Sn plating layer or a Ag plating layer on a surface.

In this case, the copper alloy plastically-worked material has a Sn plating layer or an Ag plating layer on the surface and is thus particularly suitable as a material for components for an electric or electronic device such as terminals, busbars, and heat dissipation substrate. In the present invention, "Sn plating" includes pure Sn plating or Sn alloy plating, and "Ag plating" includes pure Ag plating or Ag alloy plating.

A component for an electric or electronic device that is one aspect of the present invention is produced using the above-described copper alloy plastically-worked material. The component for an electric or electronic device in the present invention includes a terminal, a busbar, a heat dissipation substrate, and the like.

The component for an electric or electronic device having this configuration is manufactured using the above-described copper alloy plastically-worked material and is thus capable of exhibiting excellent properties even in a case where the size and the thickness are increased for large-current applications.

A terminal that is one aspect of the present invention is produced using the above-described copper alloy plastically-worked material.

The terminal having this configuration is manufactured using the above-described copper alloy plastically-worked material and is thus capable of exhibiting excellent properties even in a case where the size and the thickness are increased for large-current applications.

A busbar that is one aspect of the present invention is produced using the above-described copper alloy plastically-worked material.

The busbar having this configuration is manufactured using the above-described copper alloy plastically-worked material and is thus capable of exhibiting excellent properties even in a case where the size and the thickness are increased for large-current applications.

A heat dissipation substrate that is one aspect of the present invention is produced using the above-described copper alloy plastically-worked material. That is, at least a part of the heat dissipation substrate to be joined to a semiconductor is formed of the above-described copper alloy plastically-worked material.

The heat dissipation substrate having this configuration is manufactured using the above-described copper alloy plastically-worked material and is thus capable of exhibiting excellent properties even in a case where the size and the thickness are increased for large-current applications.

Advantageous Effects of Invention

According to the present invention, it becomes possible to provide a copper alloy, a copper alloy plastically-worked material, a component for an electronic and electronic device, a terminal, a busbar, and a heat dissipation substrate having high electrical conductivity and excellent stress relaxation resistance and being excellent in terms of bendability.

BRIEF DESCRIPTION OF THE DRAWING(S)

The figure is a flowchart of a method for manufacturing a copper alloy according to the present embodiment.

DETAILED DESCRIPTION OF THE INVENTION

Hereinafter, a copper alloy that is one embodiment of the present invention will be described.

The copper alloy that is the present embodiment has a composition in which the Mg content is set in a range of 70 mass ppm or more and 400 mass ppm or less, the Ag content is set in a range of 5 mass ppm or more and 20 mass ppm or less, and the balance is Cu and inevitable impurities, and the P content is set to less than 3.0 mass ppm.

In the copper alloy that is one embodiment of the present invention, in a case where orientation differences of respective crystal grains are analyzed by the EBSD method in a measurement area of 10000 $\mu m^2$ or more in a step of a measurement interval of 0.25 μm, except for measurement points having a CI value of 0.1 or less, regions between neighboring measurement points where the orientation difference between the measurement points becomes 15° or more are regarded as crystal grain boundaries, an average crystal grain size A is calculated by area fraction, measurement is performed in a step of a measurement interval that becomes 1/10 or less of the average crystal grain size A in a measurement area that becomes 10000 $\mu m^2$ or more in a plurality of visual fields such that a total of 1000 or more of crystal grains are included, analysis is performed except for measurement points where the CI value analyzed with data analysis software OIM is 0.1 or less, and boundaries for which the orientation difference between neighboring pixels is 5° or more are regarded as crystal grain boundaries, the average value of KAM (Kernel average misorientation) values is set to 3.0 or less.

In the copper alloy that is one embodiment of the present invention, the electrical conductivity is 90% IACS or more.

In the copper alloy that is the present embodiment, it is preferable that the 0.2% yield strength is in a range of 150 MPa or more and 450 MPa or less.

In the copper alloy that is the present embodiment, the average crystal grain size is preferably in a range of 10 μm or more and 100 μm or less.

In the copper alloy that is the present embodiment, the residual stress rate is preferably set to 50% or more at 150° C. after 1000 hours.

The reasons for specifying the component composition, the crystal texture, and a variety of properties as described above in the copper alloy of the present embodiment will be described below.

(Mg: 70 mass ppm or more and 400 mass ppm or less)

Mg is an element having an action effect of improving the strength and the stress relaxation resistance without significantly decreasing the electrical conductivity by forming solid solutions in the matrix of copper. When Mg is caused to form solid solutions in the matrix, excellent bendability can be obtained.

In a case where the Mg content is less than 70 mass ppm, there is a concern that it may become impossible to sufficiently exhibit the action effect. On the other hand, in a case where the Mg content exceeds 400 mass ppm, there is a concern that the electrical conductivity may decrease.

Based on what has been described above, in the present embodiment, the Mg content is set in a range of 70 mass ppm or more and 400 mass ppm or less.

In order to further improve the strength and the stress relaxation resistance, the Mg content is preferably set to 100 mass ppm or more, more preferably set to 150 mass ppm or more, still more preferably set to 200 mass ppm or more, and far still more preferably set to 250 mass ppm or more. In order to reliably suppress a decrease in the electrical conductivity, the Mg content is preferably set to 380 mass ppm or less, more preferably set to 360 mass ppm or less, and still more preferably set to 350 mass ppm or less.

(Ag: 5 mass ppm or more and 20 mass ppm or less)

Ag is barely capable of forming solid solutions in the matrix of Cu within an operating temperature range of ordinary electric or electronic devices of 250° C. or lower. Therefore, Ag added in a small amount to copper segregates in the vicinities of grain boundaries. This hinders the migration of atoms in the grain boundaries and suppresses grain boundary diffusion, and thus the stress relaxation resistance improves.

In a case where the Ag content is less than 5 mass ppm, there is a concern that it may become impossible to sufficiently exhibit the action effect. On the other hand, in a case where the Ag content exceeds 20 mass ppm, the electrical conductivity decreases and the cost increases.

Based on what has been described above, in the present embodiment, the Ag content is set in a range of 5 mass ppm or more and 20 mass ppm or less.

In order to further improve the stress relaxation resistance, the Ag content is preferably set to 6 mass ppm or more, more preferably set to 7 mass ppm or more, and still more preferably set to 8 mass ppm or more. In order to reliably suppress a decrease in the electrical conductivity and an increase in the cost, the Ag content is preferably set to 18 mass ppm or less, more preferably set to 16 mass ppm or less, and still more preferably set to 14 mass ppm or less.

(P:Less than 3.0 mass ppm)

P that is contained in copper promotes the recrystallization of some crystal grains during a heat treatment at a high temperature and forms coarse crystal grains. When coarse crystal grains are present, the rough skin of the surface becomes large during bending, and stress concentrates in that portion, and thus the bendability deteriorates. Furthermore, P reacts with Mg to form crystals during casting and acts as an origin of fracture during working, which makes it easy for breaking to occur during cold working or bending.

Based on what has been described above, in the present embodiment, the P content is limited to less than 3.0 mass ppm.

The P content is preferably less than 2.5 mass ppm and more preferably less than 2.0 mass ppm.

(Inevitable impurities)

As inevitable impurities other than the above-described elements, Al, B, Ba, Be, Bi, Ca, Cd, Cr, Sc, rare earth elements, V, Nb, Ta, Mo, Ni, W, Mn, Re, Fe, Se, Te, Ru, Sr, Ti, Os, Co, Rh, Ir, Pb, Pd, Pt, Au, Zn, Zr, Hf, Hg, Ga, In, Ge, Y, As, Sb, Tl, N, C, Si, Sn, Li, H, O, S, and the like are exemplary examples. These inevitable impurities are preferably as little as possible since there is a concern that the inevitable impurities may decrease the electrical conductivity.

(KAM (Kernel Average Misorientation) Value)

The KAM (Kernel average misorientation) value that is measured by EBSD is a value calculated by averaging the orientation differences between one pixel and pixels surrounding the above-described pixel. Since the shape of the pixel is a regular hexagon, in a case where the proximity order is set to 1 (1st), the average value of the orientation differences with six neighboring pixels is calculated as the KAM value. The use of this KAM value makes it possible to visualize local orientation differences, that is, the distribution of strain.

Since a region where this KAM value is high is a region where the density of dislocations introduced during working (GN dislocations) is high, high-speed diffusion of atoms through the dislocations as paths is likely to occur, and stress relaxation is likely to occur. Therefore, when the average value of the KAM values is controlled to 3.0 or less, it becomes possible to improve the stress relaxation resistance while maintaining the yield strength.

The average value of the KAM values is, even within the above-described range, preferably 2.8 or less and more preferably 2.6 or less. Incidentally, the lower limit of the average value of the KAM values is not particularly limited; however, in order to secure the work-hardening amount and obtain a sufficient strength, the average value of the KAM values is preferably 0.8 or more and more preferably 1.0 or more.

In the present embodiment, the KAM value is calculated except for measurement points where the CI (confidence index) value, which is a value measured with analysis software OIM Analysis (ver. 7.3.1) of an EBSD device, is 0.1 or less. The CI value is calculated using a Voting method at the time of indexing an EBSD pattern obtained from a certain analysis point and has a value of 0 to 1. Since the CI value is a value that evaluates the reliability of indexing and orientation calculation, in a case where the CI value is low, that is, a clear crystal pattern cannot be obtained at the analysis point, it can be said that strain (worked texture) is present in the texture. In a case where strain is particularly large, the CI value has a value of 0.1 or less.

(Electrical Conductivity: 90% IACS or More) In the copper alloy that is the present embodiment, the electrical conductivity is 90% IACS or more. When the electrical conductivity is set to 90% IACS or more, the generation of heat during electrical conduction is suppressed, which makes it possible to favorably use the copper alloy as components for an electric or electronic device such as terminals, busbars, and heat dissipation substrates as a substitute for pure copper.

The electrical conductivity is preferably 92% IACS or more, more preferably 93% IACS or more, still more preferably 95% IACS or more, and far still more preferably 97% IACS or more.

(0.2% yield strength: 150 MPa or more and 450 MPa or less)

In the copper alloy that is the present embodiment, in a case where the 0.2% yield strength is 150 MPa or more, the copper alloy is particularly suitable as a material for components for an electric or electronic device such as terminals, busbars, and heat dissipation substrates. In the present embodiment, the 0.2% yield strength at the time of performing a tensile test in a direction parallel to a rolling direction is preferably set to 150 MPa or more. At the time of manufacturing terminals, busbars, heat dissipation substrates, and the like by pressing, coil-wound strip materials are used to improve productivity; however, when the 0.2% yield strength exceeds 450 MPa, a curl is formed in a coil, and the productivity deteriorates. Therefore, the 0.2% yield strength is preferably set to 450 MPa or less.

The 0.2% yield strength is more preferably 200 MPa or more and still more preferably 220 MPa or more. The 0.2% yield strength is more preferably 440 MPa or less and still more preferably 430 MPa or less.

(Average crystal grain size: 10 μm or more and 100 μm or less) In the copper alloy that is the present embodiment, in a case where the average crystal grain size is set to 10 μm or more, crystal grain boundaries which serve as the diffusion paths of atoms are not present more than necessary, and it becomes possible to further improve the stress relaxation resistance.

On the other hand, in the copper alloy that is the present embodiment, in a case where the average crystal grain size is set to 100 μm or less, it is not necessary to perform a heat treatment for recrystallization at a high temperature for a long period of time, and an increase in the manufacturing cost can be suppressed.

The average crystal grain size is preferably 15 μm or more and preferably 80 μm or less.

(Residual Stress Rate (at 150° C. after 1000 Hours): 50% or More)

In the copper alloy that is the present embodiment, in a case where the residual stress rate is set to 50% or more at 150° C. after 1000 hours, it is possible to suppress permanent deformation to a small extent even in a case where the copper alloy is used in a high-temperature environment, and a decrease in the contact pressure can be suppressed. Therefore, it becomes possible to apply the copper alloy that is the present embodiment as a terminal that is used in a high-temperature environment such as around an engine room of an automobile.

The residual stress rate at 150° C. after 1000 hours is preferably set to 60% or more, more preferably set to 70% or more, still more preferably 75% or more, and most preferably 78% or more.

Next, a method for manufacturing the copper alloy that is the present embodiment configured as described above will be described with reference to a flowchart shown in the figure.

(Melting and Casting Step S01)

First, Mg is added to molten copper obtained by melting a copper raw material to adjust components, and a molten copper alloy is produced. In the addition of Mg, pure Mg, a Cu—Mg mother alloy, or the like can be used. In addition, a raw material containing Mg may be melted together with the copper raw material. In addition, a recycled material and a scrap material of the present alloy may also be used.

The molten copper is preferably so-called 4N Cu having a purity of 99.99 mass % or more or so-called 5N Cu having a purity of 99.999 mass % or more. In the melting step, in order to suppress the oxidation of Mg or reduce the hydrogen concentration, it is preferable to perform atmosphere melting in which an inert gas atmosphere (for example, Ar gas) having a low vapor pressure of $H_2O$ is used and to keep the holding time during melting to the minimum extent.

In addition, the molten copper alloy having an adjusted component is injected into a casting mold to produce an ingot. In the case of taking mass production into account, a continuous casting method or a semi-continuous casting method is preferably used.

(Homogenization/Solutionization Step S02)

Next, a heating treatment is performed for the homogenization and solutionization of the obtained ingot. In the ingot, there is a case where an intermetallic compound containing Cu and Mg as main components, which is generated due to the concentration of Mg by segregation in a solidification process, or the like is present. Therefore, in order to eliminate or reduce these segregation, intermetallic compound, and the like, a heating treatment is performed by heating the ingot up to 300° C. or higher and 900° C. or lower, thereby homogeneously diffusing Mg or forming solid solutions of Mg in the matrix in the ingot. This homogenization/solutionization step S02 is preferably performed in a non-oxidizing or reducing atmosphere for a holding time of 10 minutes or longer and 100 hours or shorter.

When the heating temperature is lower than 300° C., there is a concern that the solutionization may become incomplete and a large amount of the intermetallic compound containing Cu and Mg as main components may remain in the matrix. On the other hand, when the heating temperature exceeds 900° C., there is a concern that some of the copper material may turn into a liquid phase and the texture or surface state may become non-uniform. Therefore, the heating temperature is set in a range of 300° C. or higher and 900° C. or lower.

In order to perform rough working, which will be described below, efficiently and homogenize the texture, hot working may be performed after the homogenization/solutionization step S02. In this case, a working method is not particularly limited, and, for example, rolling, drawing, extrusion, groove rolling, forging, pressing, or the like can be adopted. The hot working temperature is preferably set in a range of 300° C. or higher and 900° C. or lower.

(Rough Working Step S03)

Rough working is performed to work the ingot into a predetermined shape. A temperature condition in this rough working step S03 is not particularly limited, but is preferably set within a range from −200° C. to 200° C., where the rough working becomes cold or warm rolling, and particularly preferably normal temperature in order to suppress recrystallization or improve the dimensional accuracy. The working rate is preferably 20% or more and more preferably 30% or more. A working method is not particularly limited, and, for example, rolling, drawing, extrusion, groove rolling, forging, pressing, or the like can be adopted.

(Intermediate Heat Treatment Step S04)

After the rough working step S03, a heat treatment is performed to soften the ingot for workability improvement or form a recrystallized texture.

At this time, in order to prevent localization of the segregation of Ag into grain boundaries, a short-time heat treatment using a continuous annealing furnace is preferable. Additionally, in order to further uniform the segregation of Ag into the grain boundaries, the intermediate heat treatment step S04 and a finish working step S05, which will be described below, may be repeated.

Since this intermediate heat treatment step S04 becomes a substantially final recrystallization heat treatment, the crystal grain sizes of a recrystallized texture obtained in this step become almost equal to the final crystal grain sizes. Therefore, it is preferable to set the heat treatment conditions so that the average crystal grain size in the copper alloy (copper alloy plastically-worked material), which is the final product, falls within a predetermined range. In a case where the average crystal grain size in the copper alloy (copper alloy plastically-worked material), which is the final product, is set in a range of 10 μm or more and 100 μm or less, the ingot is preferably held at a holding temperature of 400° C. or higher and 900° C. or lower for a holding time of 10 seconds or longer and 10 hours or shorter, for example, at 700° C. for approximately 1 second to 120 seconds.

(Finish Working Step S05) In order to work the copper material after the intermediate heat treatment step S04 into a predetermined shape, finish working is performed. A temperature condition in this finish working step S05 is not particularly limited, but is preferably set within a range from −200° C. to 200° C., where the finish working becomes cold or warm working, and particularly preferably normal temperature in order to suppress recrystallization during the working or suppress softening. The working rate is appropriately selected such that the shape of the copper material becomes close to the final shape and is preferably set to 5% or more in order to improve the strength by work hardening.

On the other hand, in order to suppress an excessive increase in the KAM value, the working rate is preferably set to 85% or less, and the working rate is more preferably set to 80% or less.

A working method is not particularly limited, and, for example, rolling, drawing, extrusion, groove rolling, forging, pressing, or the like can be adopted. Generally, the working rate is the area reduction rate of rolling or wire drawing.

(Finish Heat Treatment Step S06)

Next, a finish heat treatment may be performed on the plastically-worked material obtained by the finish working step S05 in order for the segregation of Ag into grain boundaries and the removal of residual strain.

When the heat treatment temperature is too low in the finish heat treatment step S06, since the KAM value increases excessively, the heat treatment temperature is preferably set in a range of 100° C. or higher and 800° C. or lower. In this finish heat treatment step S06, it is necessary to set heat treatment conditions (temperature and time) such that a significant decrease in the strength due to recrystallization is avoided. For example, the copper material is preferably held at 600° C. for approximately 0.1 seconds to 10 seconds or held at 250° C. for 1 hour to 100 hours. This heat treatment is preferably performed in a non-oxidizing atmosphere or a reducing atmosphere. A method for the heat treatment is not particularly limited, but a short-time heat treatment using a continuous annealing furnace is preferable due to an effect on manufacturing cost reduction.

The finish working step S05 and the finish heat treatment step S06 may be repeatedly performed.

The copper alloy (copper alloy plastically-worked material) that is the present embodiment is produced as described above. The copper alloy plastically-worked material produced by rolling is referred to as the copper alloy rolled sheet.

In a case where the sheet thickness of the copper alloy plastically-worked material is set to 0.5 mm or more, the copper alloy plastically-worked material is suitable for uses as a conductor in large-current applications. When the sheet thickness of the copper alloy plastically-worked material is set to 8.0 mm or less, it is possible to suppress an increase in the load on a press machine and secure productivity per unit time, and the manufacturing cost can be suppressed.

Therefore, the sheet thickness of the copper alloy plastically-worked material is preferably set in a range of 0.5 mm or more and 8.0 mm or less.

The sheet thickness of the copper alloy plastically-worked material is preferably set to more than 1.0 mm and more preferably set to more than 2.0 mm. On the other hand, the sheet thickness of the copper alloy plastically-worked material is preferably set to less than 7.0 mm and more preferably set to less than 6.0 mm.

The copper alloy that is the present embodiment configured as described above has a composition in which the Mg content is set in a range of 70 mass ppm or more and 400 mass ppm or less, the Ag content is set in a range of 5 mass ppm or more and 20 mass ppm or less, and the balance is Cu and inevitable impurities, the P content is set to less than 3.0 mass ppm, and the average value of the KAM values is specified to 3.0 or less, and thus it is possible to improve the stress relaxation resistance without significantly decreasing the electrical conductivity, and it becomes possible to achieve both high electrical conductivity of 90% IACS or more and excellent stress relaxation resistance. It also becomes possible to improve the bendability.

In the copper alloy that is the present embodiment, in a case where the 0.2% yield strength is set in the range of 150 MPa or more and 450 MPa or less, even when the copper alloy is wound into a coil shape as a sheet strip material having a thickness of more than 0.5 mm, no curls are formed, handling is easy, and high productivity can be achieved. Therefore, the copper alloy is particularly suitable as a copper alloy for components for an electric or electronic device such as terminals for large currents and high voltages, busbars, and heat dissipation substrates.

In the copper alloy that is the present embodiment, in a case where the average crystal grain size is set in the range of 10 μm or more and 100 μm or less, crystal grain boundaries that serve as the diffusion paths of atoms are not present more than necessary, and it becomes possible to reliably improve the stress relaxation resistance. It is not necessary to perform the heat treatment for recrystallization at a high temperature for a long period of time, and an increase in the manufacturing cost can be suppressed.

In the copper alloy that is the present embodiment, in a case where the residual stress rate is set to 50% or more at 150° C. after 1000 hours, the stress relaxation resistance is sufficiently excellent, and the copper alloy is particularly suitable as a copper alloy configuring components for an electric or electronic device that are used in high-temperature environments.

The copper alloy plastically-worked material that is the present embodiment is made of the above-described copper alloy and is thus excellent in terms of an electrical conductive property, stress relaxation resistance, and bendability and is particularly suitable as a material of components for an electric or electronic device such as thickened terminals, busbars, and heat dissipation substrates.

In a case where the copper alloy plastically-worked material that is the present embodiment is made into a rolled sheet having a thickness in a range of 0.5 mm or more and 8.0 mm or less, components for an electric or electronic device such as terminals, busbars, and heat dissipation substrates can be relatively easily formed by performing punching or bending on this copper alloy plastically-worked material (rolled sheet).

In a case where a Sn plating layer or a Ag plating layer is formed on a surface of the copper alloy plastically-worked material that is the present embodiment, the copper alloy plastically-worked material is particularly suitable as a material of components for an electric or electronic device such as terminals, busbars, and heat dissipation substrates.

A component for an electric or electronic device (a terminal, a busbar, a heat dissipation substrate, or the like) that is the present embodiment is formed of the above-described copper alloy plastically-worked material and is thus capable of exhibiting excellent properties even when the size and thicknesses are increased.

Hitherto, the copper alloy, the copper alloy plastically-worked material, and the component for an electric or electronic device (a terminal, a busbar, a heat dissipation substrate, or the like) that are the embodiment of the present invention have been described, but the present invention is not limited thereto and can be modified as appropriate without departing from the technical concept of the invention.

For example, in the above-described embodiment, an example of the method for manufacturing the copper alloy (copper alloy plastically-worked material) has been described, but the method for manufacturing the copper alloy is not limited to what has been described in the embodiment, and the copper alloy may be manufactured by appropriately selecting an existing manufacturing method.

EXAMPLES

Hereinafter, the results of confirmation experiments performed to confirm the effect of the present invention will be described.

A raw material made of pure copper having a purity of 99.999 mass % or more purified to a P concentration of 0.001 mass ppm or less by a zone-melting purification method was charged into a high-purity graphite crucible and melted with a high frequency in an atmosphere furnace in which an Ar gas atmosphere is formed.

A mother alloy containing 1 mass % of a variety of additive elements produced using high-purity copper of 6N (purity: 99.9999 mass %) or higher and a pure metal having a purity of 2N (purity: 99 mass %) or higher was added to the obtained molten copper to prepare components and poured into a heat insulating material (isowool) casting mold, thereby producing ingots having a component composition shown in Tables 1 and 2.

The sizes of the ingot were set to approximately 30 mm in thickness, approximately 60 mm in width, and approximately 150 to 200 mm in length.

The obtained ingots were heated at 800° C. for 1 hour (homogenization/solution treatment) in an Ar gas atmosphere, the surfaces were ground to remove oxide films, and the ingots were cut to predetermined sizes. After that, the thicknesses were adjusted so as to become the final thicknesses as appropriate, and the ingots were cut.

On the cut individual specimens, rough rolling (rough working) and an intermediate heat treatment were performed under conditions shown in Tables 1 and 2, and then, furthermore, finish rolling and a finish heat treatment were performed, thereby producing strip materials for property evaluation each having a thickness described in Tables 1 and 2 and a width of approximately 60 mm.

In addition, the following items were evaluated.

(Composition Analysis)

A measurement specimen was collected from the obtained ingot, Mg was measured by inductively coupled plasma emission spectroscopy, and other elements were measured using a glow discharge mass spectrometer (GD-MS). Measurement was performed at two sites, the central portion of the specimen and an end portion in the width direction, and a larger content was regarded as the content of the sample. As a result, it was confirmed that the ingots had component compositions shown in Tables 1 and 2.

(Average Value of KAM Values/Average Crystal Grain Size)

A rolled surface, that is, an ND surface (Normal direction) was used as an observation surface, and the average value of the KAM values and the average crystal grain size were measured as described below with an EBSD measuring instrument and OIM analysis software.

The rolled surface was mechanically polished using waterproof abrasive paper and diamond abrasive grains, and then finish-polished using a colloidal silica solution. In addition, orientation differences of respective crystal grains were analyzed with the EBSD measuring instrument (Quanta FEG 450 manufactured by Thermo Fisher Scientific, OIM Data Collection manufactured by EDAX/TSL (currently AMETEK Inc.)) and the analysis software (OIM Data Analysis ver 7.3.1 manufactured by EDAX/TSL (currently AMETEK Inc.)) at an electron beam accelerating voltage of 15 kV in a measurement area of 10000 $\mu m^2$ or more in a step of a measurement interval of 0.25 μm, except for measurement points having a CI value of 0.1 or less, regions between neighboring measurement points where the orientation difference between the measurement points became 15° or more were regarded as crystal grain boundaries, and the average crystal grain size A was obtained by area fraction that was calculated with the analysis software. After that, measurement was performed in a step of a measurement interval that became 1/10 or less of the average crystal grain size A in a measurement area that became 10000 $\mu m^2$ or more in a plurality of visual fields such that a total of 1000 or more of crystal grains were included, analysis was performed except for measurement points where the CI value analyzed with the data analysis software OIM was 0.1 or less, boundaries for which the orientation difference between neighboring pixels was 5° or more were regarded as crystal grain boundaries, the KAM value of all of the analyzed pixels were obtained, and the average value thereof was obtained.

(Mechanical Properties)

A test piece No. 13B specified in JIS Z 2241 was collected from the strip material for property evaluation, and the 0.2% yield strength was measured by an offset method of JIS Z 2241. The test piece was collected in a direction parallel to a rolling direction.

(Electrical Conductivity)

A test piece that was 10 mm in width and 60 mm in length was collected from the strip material for property evaluation, and the electrical resistance was obtained by a 4-terminal method. The dimensions of the test piece were measured using a micrometer, and the volume of the test piece was calculated. The electrical conductivity was calculated from the measured electrical resistance value and the measured volume. The test piece was collected such that the longitudinal direction became parallel to the rolling direction of the strip material for property evaluation.

(Stress Relaxation Resistance)

In a stress relaxation resistance test, stress was applied by a method according to a cantilever block method of the Japan Copper and Brass Association Technical Standard JCBA-T309:2004, and the residual stress rate after holding a test piece at a temperature of 150° C. for 1000 hours was measured.

As a test method, the test piece (10 mm in width) was collected from each strip material for property evaluation in a direction parallel to the rolling direction, an initial deflection displacement was set to 2 mm such that the maximum surface stress of the test piece became 80% of the 0.2% yield strength, and the span length was adjusted. The maximum surface stress is determined by the following equation.

$$\text{Maximum surface stress(MPa)}=1.5Et\delta_0/L_s^2$$

Here,

E: Young's modulus (MPa)

t: Specimen thickness (mm)

$\delta_0$: Initial deflection displacement (mm)

$L_s$: Span length (mm)

The residual stress rate was measured from a bending tendency formed after holding the test piece at a temperature of 150° C. for 1000 hours, and the stress relaxation resistance was evaluated. The residual stress rate was calculated using the following equation.

$$\text{Residual stress rate (\%)}=(1-\delta_t/\delta_0)\times 100$$

Here, $\delta_t$: Permanent deflection displacement after holding at 150° C. for 1000 hours (mm)— permanent deflection displacement after holding at normal temperature for 24 hours (mm) $\delta_0$: Initial deflection displacement (mm)

(Bendability)

Bending was performed according to a 4 test method of the Japan Copper and Brass Association Technical Standard JCBA-T307:2007.

A plurality of test pieces that were 10 mm in width and 30 mm in length were collected from the strip material for property evaluation such that the rolling direction and the longitudinal direction of the test piece became perpendicular to each other, and a W bend test was performed using a W type jig having a bending angle of 90 degrees and a bending radius of 0.05 mm.

In addition, the outer peripheral portion of a bent portion was visually confirmed, in a case where breaking was observed, the bendability was determined as "C", in a case where a large wrinkle was observed, the bendability was determined as "B", and, in a case where breaking, fine breaking, or a large wrinkle could not be confirmed, the bendability was determined as "A". "A" and "B" were determined as permissible bendability.

TABLE 1

| | | Component composition (mass ratio) | | | | Manufacturing step | | | | | |
|---|---|---|---|---|---|---|---|---|---|---|---|
| | | | | | | Rough rolling Rolling | Intermediate heat treatment | | Finish rolling Rolling | Finish heat treatment | |
| | | Mg ppm | Ag ppm | P ppm | Cu | reduction % | Temperature ° C. | Time sec. | reduction % | Temperature ° C. | Time sec. |
| Present Invention Example | 1 | 110 | 12 | 0.3 | Balance | 60 | 750 | 60 | 30 | 350 | 600 |
| | 2 | 150 | 9 | 0.3 | Balance | 60 | 700 | 1200 | 50 | 400 | 60 |
| | 3 | 220 | 10 | 0.3 | Balance | 60 | 700 | 120 | 25 | 375 | 60 |
| | 4 | 250 | 11 | 0.2 | Balance | 60 | 800 | 10 | 30 | 425 | 10 |
| | 5 | 110 | 8 | 0.2 | Balance | 60 | 850 | 10 | 40 | 400 | 30 |
| | 6 | 150 | 11 | 0.4 | Balance | 60 | 700 | 600 | 20 | 300 | 1800 |
| | 7 | 210 | 11 | 0.2 | Balance | 60 | 750 | 10 | 35 | 350 | 600 |
| | 8 | 250 | 11 | 0.3 | Balance | 60 | 725 | 600 | 20 | 325 | 600 |
| | 9 | 290 | 11 | 0.1 | Balance | 60 | 700 | 60 | 70 | 350 | 60 |
| | 10 | 100 | 12 | 0.3 | Balance | 60 | 650 | 1800 | 10 | 350 | 300 |
| | 11 | 160 | 12 | 0.2 | Balance | 60 | 625 | 3000 | 20 | 350 | 60 |
| | 12 | 220 | 11 | 0.3 | Balance | 60 | 750 | 60 | 15 | 400 | 60 |
| | 13 | 260 | 11 | 0.3 | Balance | 60 | 750 | 600 | 30 | 500 | 3 |
| | 14 | 330 | 5 | 0.2 | Balance | 50 | 625 | 60 | 85 | 300 | 60 |
| | 15 | 320 | 6 | 0.4 | Balance | 60 | 625 | 60 | 80 | 350 | 10 |
| | 16 | 310 | 7 | 0.3 | Balance | 60 | 650 | 30 | 80 | 325 | 600 |

TABLE 1-continued

| | | | | | | | | | | |
|---|---|---|---|---|---|---|---|---|---|---|
| 17 | 310 | 19 | 0.3 | Balance | 60 | 700 | 60 | 20 | 400 | 30 |
| 18 | 300 | 18 | 0.3 | Balance | 60 | 750 | 300 | 60 | 325 | 3000 |

| | | | | Evaluation | | | | | |
|---|---|---|---|---|---|---|---|---|---|
| | | | Thickness mm | Crystal grain size μm | KAM value | 0.2% yield strength MPa | Electrical conductivity % IACS | Residual stress rate % | Bendability |
| Present Invention Example | 1 | 0.5 | 69 | 1.6 | 262 | 99 | 78 | A |
| | 2 | 0.5 | 52 | 1.7 | 334 | 98 | 78 | A |
| | 3 | 0.5 | 33 | 1.4 | 263 | 98 | 80 | A |
| | 4 | 0.5 | 53 | 1.7 | 286 | 98 | 80 | A |
| | 5 | 2.0 | 72 | 1.7 | 293 | 99 | 78 | A |
| | 6 | 2.0 | 55 | 1.3 | 234 | 98 | 79 | A |
| | 7 | 2.0 | 43 | 1.6 | 276 | 98 | 80 | A |
| | 8 | 2.0 | 40 | 1.3 | 241 | 98 | 82 | A |
| | 9 | 2.5 | 28 | 2.2 | 371 | 98 | 79 | A |
| | 10 | 4.0 | 36 | 1.1 | 204 | 99 | 78 | A |
| | 11 | 4.0 | 33 | 1.2 | 239 | 98 | 78 | A |
| | 12 | 4.0 | 30 | 1.1 | 221 | 98 | 78 | A |
| | 13 | 4.0 | 49 | 1.6 | 248 | 98 | 81 | A |
| | 14 | 2.0 | 14 | 2.6 | 415 | 97 | 69 | A |
| | 15 | 2.0 | 15 | 2.3 | 403 | 97 | 74 | A |
| | 16 | 2.0 | 18 | 2.2 | 388 | 97 | 77 | A |
| | 17 | 2.0 | 62 | 1.1 | 220 | 97 | 83 | A |
| | 18 | 2.0 | 70 | 2.0 | 338 | 97 | 81 | A |

TABLE 2

| | | Component composition (mass ratio) | | | | Manufacturing step | | | | | |
|---|---|---|---|---|---|---|---|---|---|---|---|
| | | | | | | Rough rolling Rolling | Intermediate heat treatment | | Finish rolling Rolling | Finish heat treatment | |
| | | Mg ppm | Ag ppm | P ppm | Cu | reduction % | Temperature ° C. | Time sec. | reduction % | Temperature ° C. | Time sec. |
| Present Invention Example | 19 | 370 | 15 | 0.4 | Balance | 60 | 775 | 60 | 30 | 350 | 60 |
| | 20 | 280 | 10 | 2.9 | Balance | 60 | 825 | 120 | 75 | 325 | 60 |
| | 21 | 250 | 12 | 2.3 | Balance | 60 | 800 | 600 | 80 | 350 | 60 |
| | 22 | 390 | 10 | 1.9 | Balance | 60 | 850 | 10 | 45 | 350 | 60 |
| | 23 | 330 | 9 | 0.3 | Balance | 60 | 775 | 30 | 30 | 400 | 60 |
| | 24 | 250 | 11 | 0.2 | Balance | 60 | 725 | 60 | 10 | 300 | 60 |
| | 25 | 300 | 9 | 0.5 | Balance | 60 | 675 | 600 | 15 | 350 | 60 |
| | 26 | 200 | 11 | 0.2 | Balance | 60 | 750 | 600 | 0 | 400 | 60 |
| | 27 | 250 | 11 | 0.3 | Balance | 60 | 775 | 30 | 5 | 350 | 600 |
| | 28 | 350 | 12 | 0.5 | Balance | 60 | 650 | 1800 | 90 | 325 | 60 |
| | 29 | 340 | 11 | 0.4 | Balance | 60 | 750 | 30 | 85 | 300 | 1800 |
| | 30 | 70 | 10 | 0.3 | Balance | 33 | 600 | 60 | 90 | — | — |
| Comparative Example | 1 | 10 | 11 | 0.3 | Balance | 60 | 500 | 30 | 60 | 350 | 120 |
| | 2 | 390 | 6 | 22.0 | Balance | 50 | 750 | 300 | 85 | 300 | 120 |
| | 3 | 400 | 10 | 0.3 | Balance | 33 | 625 | 60 | 90 | 300 | 30 |
| | 4 | 110 | 1 | 0.3 | Balance | 33 | 600 | 180 | 90 | 325 | 10 |
| | 5 | 2300 | 10 | 0.3 | Balance | 60 | 600 | 10 | 60 | 350 | 60 |

| | | | | Evaluation | | | | | |
|---|---|---|---|---|---|---|---|---|---|
| | | | Thickness mm | Crystal grain size μm | KAM value | 0.2% yield strength MPa | Electrical conductivity % IACS | Residual stress rate % | Bendability |
| Present Invention Example | 19 | 2.0 | 41 | 1.6 | 246 | 96 | 82 | A |
| | 20 | 2.0 | 103 | 2.3 | 370 | 97 | 80 | B |
| | 21 | 2.0 | 83 | 2.3 | 366 | 98 | 79 | B |
| | 22 | 2.0 | 76 | 1.6 | 317 | 95 | 79 | A |
| | 23 | 8.0 | 55 | 1.3 | 276 | 98 | 81 | A |
| | 24 | 7.0 | 38 | 1.2 | 216 | 98 | 80 | A |
| | 25 | 6.0 | 38 | 1.2 | 223 | 98 | 79 | A |
| | 26 | 2.0 | 46 | 0.9 | 140 | 99 | 85 | A |
| | 27 | 2.0 | 36 | 1.0 | 183 | 99 | 83 | A |
| | 28 | 0.5 | 36 | 2.9 | 411 | 96 | 74 | B |
| | 29 | 1.0 | 26 | 2.7 | 403 | 96 | 76 | B |
| | 30 | 2.0 | 8 | 2.8 | 426 | 98 | 57 | A |

TABLE 2-continued

| | | | | | | | | |
|---|---|---|---|---|---|---|---|---|
| Comparative Example | 1 | 2.0 | 33 | 1.8 | 310 | 100 | 13 | A |
| | 2 | 2.0 | 78 | 2.4 | 413 | 97 | 62 | C |
| | 3 | 2.0 | 16 | 3.2 | 436 | 95 | 42 | A |
| | 4 | 2.0 | 15 | 2.9 | 429 | 97 | 41 | A |
| | 5 | 2.0 | 20 | 2.4 | 386 | 81 | 80 | A |

In Comparative Example 1, since the Mg content was below the range of the present invention, the residual stress rate was low, and the stress relaxation resistance was insufficient.

In Comparative Example 2, the P content was above the range of the present invention, and the bendability was determined as C, which was insufficient.

In Comparative Example 3, the average value of the KAM values exceeded the range of the present invention, the residual stress rate was low, and the stress relaxation resistance was insufficient.

In Comparative Example 4, since the Ag content was below the range of the present invention, the residual stress rate was low, and the stress relaxation resistance was insufficient.

In Comparative Example 5, the Mg content was above the range of the present invention, and the electrical conductivity became low.

In contrast, in Present Invention Examples 1 to 30, the electrical conductivity and the stress relaxation resistance were improved in a well-balanced manner, and the bendability was also excellent.

From what has been described above, it was confirmed that, according to the present invention examples, it is possible to provide a copper alloy having high electrical conductivity and excellent stress relaxation resistance and being excellent in terms of the bendability.

INDUSTRIAL APPLICABILITY

According to the present invention, it is possible to provide a copper alloy, a copper alloy plastically-worked material, a component for an electronic and electronic device, a terminal, a busbar, and a heat dissipation substrate having high electrical conductivity and excellent stress relaxation resistance and being excellent in terms of bendability.

What is claimed is:

1. A copper alloy having a composition including:

70 mass ppm or more and 400 mass ppm or less of Mg;

5 mass ppm or more and 20 mass ppm or less of Ag;

less than 3.0 mass ppm of P; and a Cu balance containing inevitable impurities, wherein an electrical conductivity of the copper alloy is 90% IACS or more, and an average value of KAM (Kernel average misorientation) values is 3.0 or less, the KAM values being obtained by:

analyzing orientation differences of each of crystal grains by using an EBSD method in a measurement area of 10000 $\mu m^2$ or more in a step of a measurement interval of 0.25 μm, excluding measurement points having a CI value of 0.1 or less;

calculating an average crystal grain size A by using area fraction, regions between neighboring measurement points where the orientation differences therebetween is 15° or more being defined as crystal grain boundaries;

measuring the orientation differences in a step of a measurement interval that is 1/10 or less of the average crystal grain size A;

analyzing the orientation differences of each of the crystal grains in a plurality of view fields including 1000 or more of the crystal grains in total, each of the view fields having 10000 $um^2$ or more of a measurement area, excluding measurement points where a CI value analyzed with data analysis software OIM is 0.1 or less; and obtaining the KAM values as values when grain boundaries are defined as boundaries having 5° or more of orientation differences between neighboring pixels.

2. The copper alloy according to claim 1, wherein a 0.2% yield strength is in a range of 150 MPa or more and 450 MPa or less.

3. The copper alloy according to claim 1, wherein an average crystal grain size is in a range of 10 μm or more and 100 μm or less.

4. The copper alloy according to claim 1, wherein a residual stress rate is 50% or more at 150° C. after 1000 hours.

5. A copper alloy plastically-worked material made of the copper alloy according to claim 1.

6. The copper alloy plastically-worked material according to claim 5, wherein the copper alloy plastically-worked material is a rolled sheet having a thickness in a range of 0.5 mm or more and 8.0 mm or less.

7. The copper alloy plastically-worked material according to claim 5, wherein the copper alloy plastically-worked material includes a Sn plating layer or a Ag plating layer on a surface.

8. A component for an electric or electronic device produced using the copper alloy plastically-worked material according to claim 5.

9. A terminal produced using the copper alloy plastically-worked material according to claim 5.

10. A busbar produced using the copper alloy plastically-worked material according to claim 5.

11. A heat dissipation substrate produced using the copper alloy plastically-worked material according to claim 5.

* * * * *